United States Patent [19]

Anderson

[11] 4,187,655

[45] Feb. 12, 1980

[54] PANEL CONSTRUCTED BUILDING

[76] Inventor: Ernest L. Anderson, 4606 148th Ave. NE., Bellevue, Wash. 98007

[21] Appl. No.: 875,422

[22] Filed: Feb. 6, 1978

Related U.S. Application Data

[60] Division of Ser. No. 657,473, Feb. 12, 1976, Pat. No. 4,090,339, which is a continuation-in-part of Ser. No. 192,601, Oct. 26, 1971, abandoned, which is a continuation of Ser. No. 823,590, May 12, 1969, abandoned.

[51] Int. Cl.[2] ..... E04H 1/00

[52] U.S. Cl. ..... 52/236.6; 52/90; 52/580; 52/592

[58] Field of Search ..... 52/90, 236.6, 580, 592, 52/620, 236.3

[56] References Cited

U.S. PATENT DOCUMENTS

| | | | |
|---|---|---|---|
| 76,593 | 7/1904 | Mahony | 52/580 |
| 1,747,313 | 2/1930 | Miss | 52/90 |
| 2,129,441 | 9/1938 | Otto | 52/90 |
| 2,339,220 | 1/1944 | Crowley | 52/236.6 X |
| 2,453,326 | 11/1948 | Lambert | 52/90 |
| 2,825,098 | 3/1958 | Hultquist | 52/580 |
| 3,529,393 | 9/1970 | Wilkins | 52/282 X |

FOREIGN PATENT DOCUMENTS

| | | | |
|---|---|---|---|
| 750973 | 6/1933 | France | 52/592 |

*Primary Examiner*—Alfred C. Perham
*Attorney, Agent, or Firm*—Seed, Berry, Vernon & Baynham

[57] ABSTRACT

The interconnectable border frames with protrusions and grooves are also provided in an improved wooden form for panels which can be combined to form the essential roof, wall, and floor components of a complete building. The floor and wall panels uniquely provide for selectivity in the location of the floor panels along the vertical height of the wall panels.

6 Claims, 13 Drawing Figures

FIG. 3
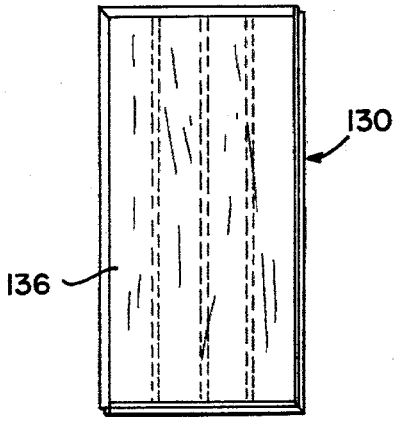
FIG. 5
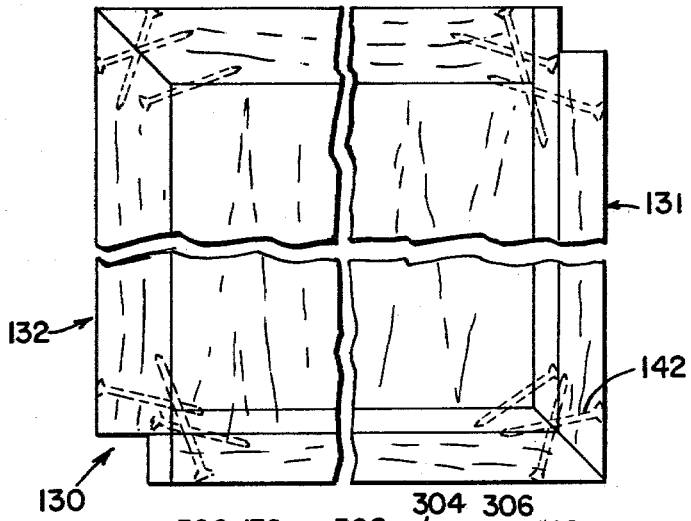
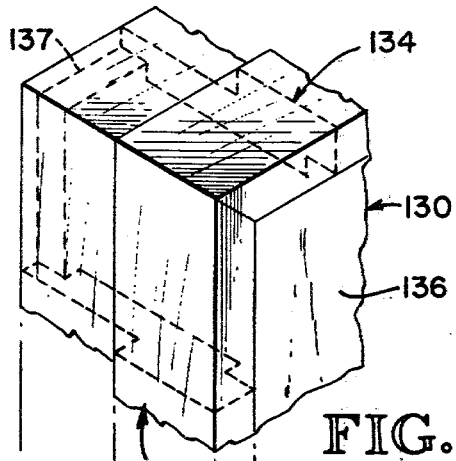
FIG. 4UL
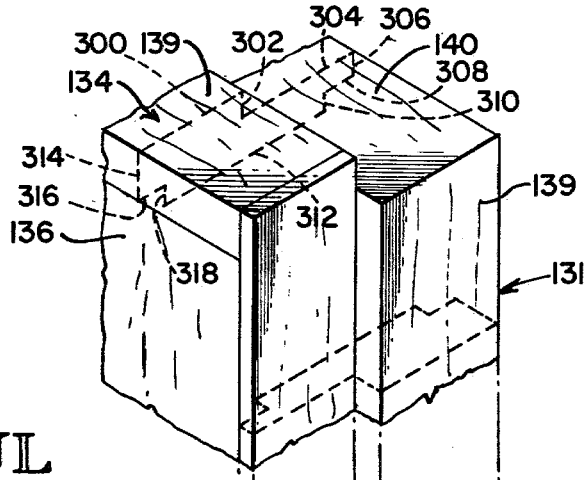
FIG. 4UR
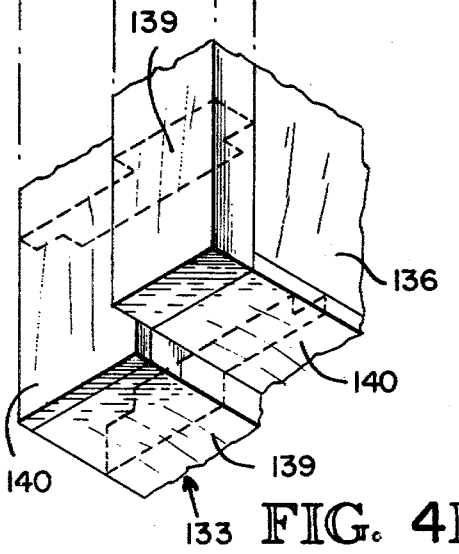
FIG. 4LL
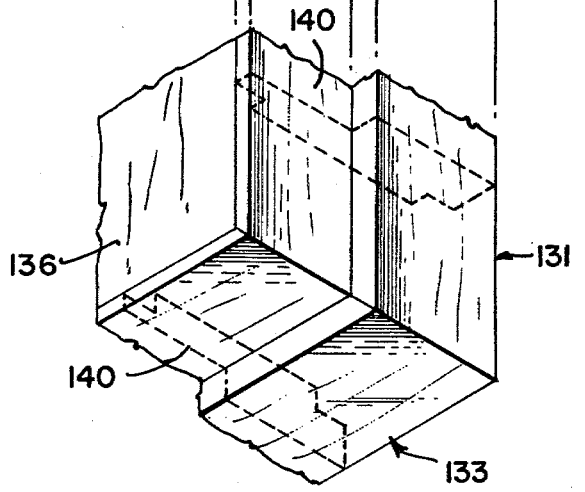
FIG. 4LR

PANEL CONSTRUCTED BUILDING

CROSS-REFERENCE TO RELATED APPLICATION

This is a division of application Ser. No. 657,473, filed Feb. 12, 1976, which is a continuation-in-part of application Ser. No. 192,601 filed Oct. 26, 1971, which is a streamlined continuation of application Ser. No. 823,590, filed May 12, 1969.

BACKGROUND OF THE INVENTION

1. Field of the Invention

The present invention relates to preformed structural members and, more particularly, to load-bearing preformed structural members, such as modular wall, roof and floor panels which interfit to provide a self-supporting wall, load-supporting walls, roofs and floors, and to beam members used with or separate from the panels.

2. Description of the Prior Art

Heretofore, preformed modular panels have generally consisted of two opposed lightweight facing materials joined by equally lightweight border frames. The structural strength necessary to support the roof of the building made from such preformed panels was developed solely from the high-strength posts and beams. Panels, in general, were thus used solely for weatherproofing or for internal partitioning. In addition, prior art modular panels have been difficult to assemble into complete buildings.

SUMMARY OF THE INVENTION

This invention provides a preformed structural member, primarily a modular panel of various embodied forms, which has sufficient internal strength to bear loads normally borne by posts and beams made of high-strength materials. This internal strength is derived from the integral interconnection of surface materials (in the case of panels) or elongated load-supporting members (in the case of beams) with higher strength frame members. The frame members in one embodiment (hereinafter first embodiment) have spaced integral protrusions that are inserted into the kerfs in the surface materials or load-supporting members. In the case of a panel the frame members form an integral border frame surrounding the peripheral edges of the surface materials. In the case of the beam the frame members need join only the upper and lower edges of the load-supporting members. In both cases the protrusions of the frame members are adhesively bonded in the kerfs.

An important general object of all embodiments of the invention is to provide a panel which has a rigid border frame joining spaced surface sheets such as to form a panel of much greater strength than the frame members or sheets would have if used individually in conventional construction.

A further object of the first embodiment panel of the invention is to provide preformed, load-bearing wall panels which interfit with adjacent wall panels and which may be joined on the job site without the need of special tools or skills.

Another object of the first and second embodiment panels is to provide a preformed wall panel that contains accessory components, such as windows or doors, which are connected to the wall panels by framing members that function additionally to join the surface sheets of the panel and which are especially adapted to permit installation of the component at the construction site.

Still another object is to provide various frame members that may join two or more surface sheets or load-bearing members together and may support various components of a building.

Still a further object of all embodiments of the panels is to provide a panel which is sealed and whose elements are sealed for weather integrity so that it can be erected at the job site under adverse moisture conditions and does not require further weather resisting siding and the like. In addition, the sealed construction restricts movement of moisture and heat into the panels and through the panels both from outside the building as well as from human or animal generated heat and moisture from within the building.

It is an important feature that the border frame has a spline or a notch in abutting contact with the plywood face sheets to provide resistance to shearing of the plywood as well as to the loading in the plane of the sheets.

Still another feature is to provide for balloon construction by the use of the floor and wall panels which allows positioning floors vertically offset from the lower ends of side wall panels for ceiling height flexibility.

Still another object of all embodiments of the panels is to provide preformed panels which will interfit with like panels placed side-by-side or end-for-end and which are weather-sealed at the joint.

Another object is to provide structural floor and roof panels that interfit end-for-end or side-for-side and which can be assembled at the construction site without the need for special skills or tools.

BRIEF DESCRIPTION OF THE DRAWINGS

FIG. 3 is a front elevation of a floor or roof panel and designated as a third embodiment panel of this invention.

FIG. 4 are fragmentary isometric corner views of the third embodiment panel. FIG. 4UL is an upper-left corner; FIG. 4LL is a lower-left corner; FIG. 4UR is an upper-right corner; FIG. 4LR is a lower-right corner.

FIG. 5 is an enlarged front elevation of the third embodiment panel.

DESCRIPTION OF THE PREFERRED EMBODIMENT

Figures 1, 6, 7, 8:
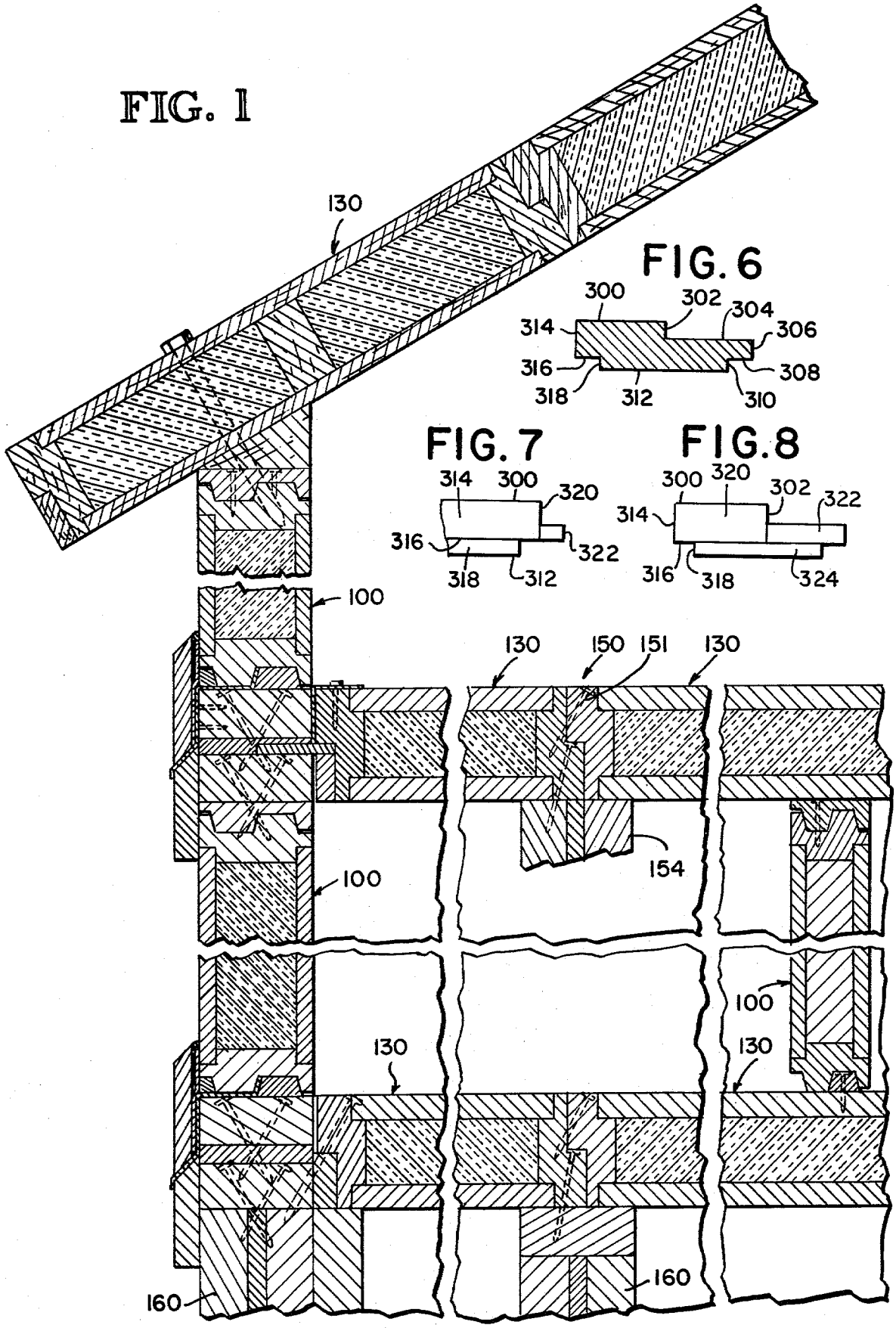
FIG. 1 is a vertical section of a typical building constructed of second and third embodiment panels of this invention.
FIGS. 6–8 are respectively a cross-sectional view of an end rail, a fragmentary side elevational view of an end rail, and an end elevational view of a rail.

The panel unit 100 forms the basic building block for vertical side walls of the structure and will be provided in generally 4×8 feet dimensions, however, smaller units such as 2×8 feet panels may also be used for versatility. Another embodiment panel 130 is shown in FIGS. 3–5. This panel unit is used for horizontal floors or horizontal or sloping roofs. Generally, these panels will also be in 2×8 feet or 4×8 feet dimensions also.

The panels 130 each include a set of side rails 131 and 132 and identical end rails 133 and 134. The end rails and side rails are turned end-for-end relative to one another as in the panel unit 100. Similarly, face sheets 136 and 137 are joined to the rails which in turn are joined to one another by suitable fasteners and bonding.

As is readily apparent in the embodiment of FIGS. 3–5, each of the rails includes a protusion 139 and a recess or groove 140. The side rails are turned end-for-end relative to one another as are the end rails. Accordingly the protrusion 139 of side rail 131 is shortened along its length to end flush with the groove 140 of the end rail 134. Similarly, the protusion 139 of side rail 132 has a shortened length to end flush with the groove 140 of end rail 133.

More specifically, each end rail includes a head wall 300, a riser wall 302, a step wall 304, a first outer wall 306, a first shoulder wall 308, a first neck wall 310, a first base wall 312, a second outer wall 314, a second shoulder wall 316, a second neck wall 318, an intermediate cut-back end wall 320, an outermost end wall 322, an innermost cut-back end wall 324.

Screws 142 or other suitable fasteners hold the side rails and end rails together along with staples, not shown, which secure the face sheets 136 and 137 to the rails. In addition, the face sheets and the rails can be bonded together to form the structural integral panel unit. That is, the panel unit is a structral entity in itself, a load supporting component of the total building, and is used as a substitute for roof joists, floor joists and rafters.

Figure 2:
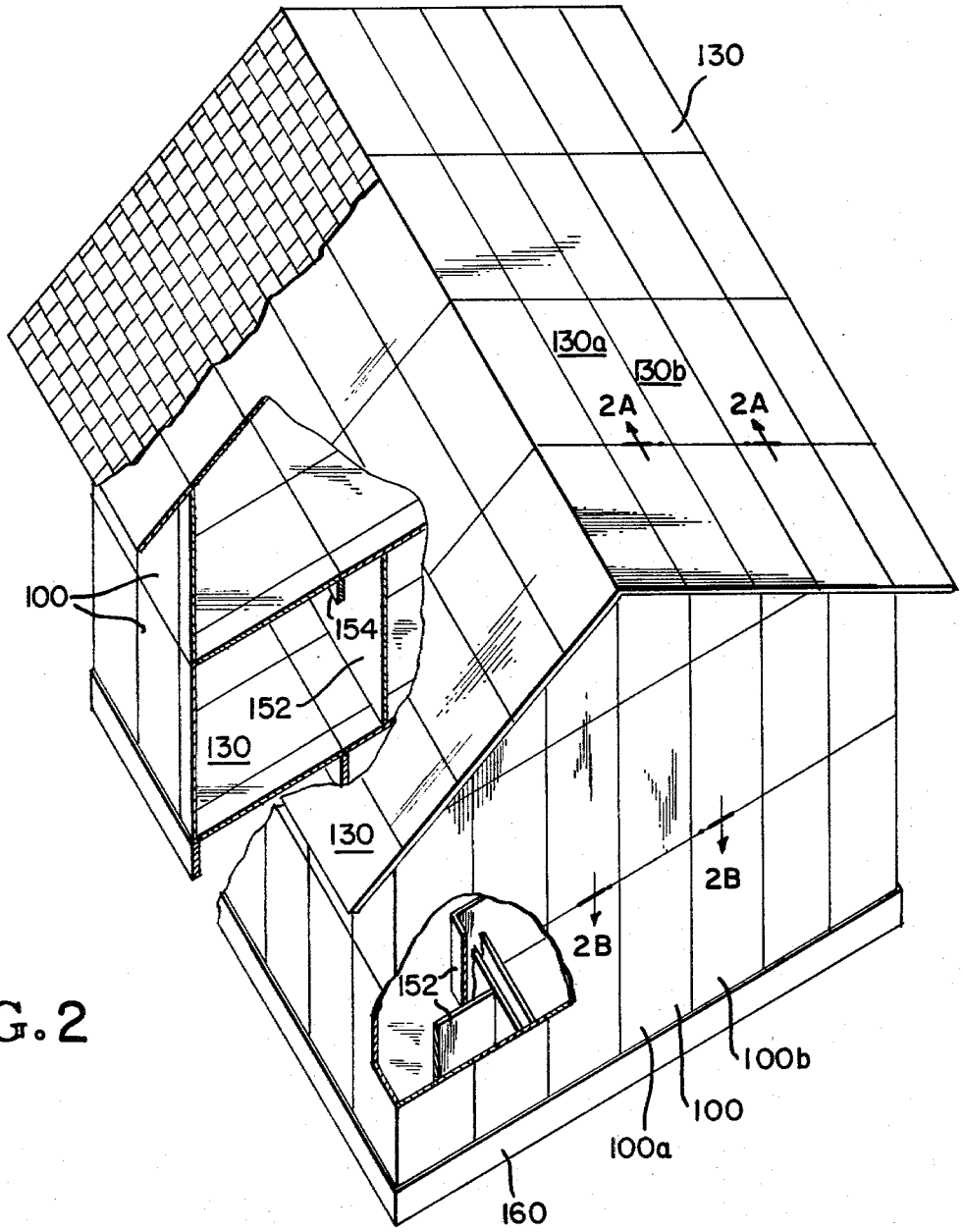
FIG. 2 is an isometric of a typical building constructed of second and third embodiment panels of this invention and with parts broken away for clarity.
Figure 2A:
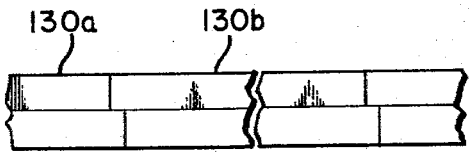
FIGS. 2A and 2B are fragmentary elevations showing two interconnected third embodiment roof panels and second embodiment wall panels, respectively.
Figure 2B:
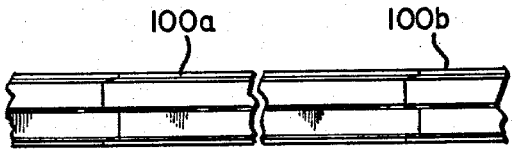

FIGS. 1 and 2 illustrate a complete building formed of the unique panel units. For example, FIG. 1 illustrates a roof and combined joints formed of panel units 130 of the type illustrated in FIGS. 3–4. Panel units 100 are used in each of the various stories of the building as the side wall and interior wall components. The panel units 130 are also carried out throughout the building as ceiling and floor components. These ceiling and floor components with their unique end rail constructions overlap as at 150, for example, to provide a positive mechanical interconnection between the panel units which may be securely tied together through the use of nails or screws 151. An exterior view of the building with parts broken away, shows roof panels and floor panels 130 combined with the panel units 100 resting on a foundation 150 of conventional construction. Similarly, non-structural curtain walls or structural walls within the building 152 may be used for room division and if a room division does not end beneath a joint 150, a beam 154 is employed to support the joint.

As is readily apparent, the further use of the panel units 130 combined with other side wall panel units 100 illustrated enables essentially all of the individual structural elements of the building to be premanufactured with structural integrity so that the entire two-story building can be assembled at the building site in a minimum amount of time and with a minimum amount of labor. If desired, window units, door units, plumbing, etc., can all be manufactured into the various panels with the architect or builder having the option to choose from a variety of such panels in designing the house to the needs of the owner. Exacting carpentry as is required during conventional building construction is eliminated since the tolerances in the panel units are accurately determined during manufacture. Thus the ultimate cost of construction has only a minimal amount of expensive carpenter labor involved. Finally, the entire house with only a minimal amount of conventional construction supplies can be packaged and shipped over long distances and quickly erected at the building site.

One additional unique feature is made possible by the combined structural wall and floor panels. Conventional housing construction lays the wall studding on a plate directly over the floor joists thus fixing the vertical position of the floor to the bottom of a wall. In this invention the floors and walls are separately integral structural components. As a result, the floor panels can be easily arranged to be secured to beams hung from the wall panels and thus positioned at any desired vertical location along the panels. Applications of this principle could allow easily arranged first or upper story ceilings that are of a height less than the standard generally 8 foot ceiling now in conventional housing construction. For example, lower ceilings could be provided for shorter races of people or for storage areas to save construction cost and heat loss. FIG. 1 illustrates how floor panels 130 are locked to the sidewall panels 100 in one embodiment, however, as is obvious, beams 154 could be attached around the interior side wall panels at lower locations and the floor panels abutted against the side wall panels as illustrated but resting on the beams. Wall spacing would become less flexible but this would be more than compensated for by the increased vertical floor height flexibility.

The embodiments of the invention in which a particular property or privilege is claimed are defined as follows:

1. A structural panel assembly for use in a panel constructed building comprising two parallel face sheets;

a rigid rectangular border frame surrounding said face sheets and having end rails interconnected by side rails, all of said rails having the same transverse cross-section but with said side rails turned end-for-end relative to one another and with said end rails also turned end-for-end relative to one another so that a first end rail and a first of the side rails having one cross-sectional orientation and the second end rail and the second side rail have the opposite cross-sectional orientation, said cross sections being so shaped that like border frames juxtaposed side against side will interfit at the sides by sliding engagement along a plane parallel to the longitudinal planes of said face sheets;

each rail of a set of an end rail and an adjoining side rail having a mating bevel cut across its end so that said ends abut flush with one another, each rail of a set of an end rail and an adjoining side rail having an opposite end which is not bevel cut, one of said opposite ends having a full right angle cross-sectional cut, the remaining opposite end having a tongue protruding outwardly longitudinally of the rail to fully overlap a portion of the opposite end of the rail which has the full right angle cross-sectional cut, said remaining opposite end also having an internal cut back end wall leaving a surface covering flush the remaining portion of the opposite end having the full right angle cross-sectional cut, said face sheets being permanently attached to all said rails, and means securing said rails together to form a rigid border frame and for securing said face sheets to said border frame.

2. A structural panel assembly comprising:

two parallel face sheets;

a rigid rectangular border frame surrounding said sheets and having end rails interconnected by side rails, all of said rails having the same transverse cross-section but with said side rails turned end-for-end relative to one another and with said end rails also turned end-for-end relative to one another so that a first end rail and a first of the side rails have one cross-sectional orientation and the second end rail and the second side rail have the opposite cross-sectional orientation, said cross-sections being so shaped that like border frames juxtaposed side against side will interfit at the sides by sliding engagement along a plane parallel to the longitudinal planes of said face sheets;

each said rail being of generally rectangular transverse cross-section, stepped at a head wall and necked at the opposite base wall to provide, in consecutive adjoining order, a head wall, a center riser wall, a step wall, a first outer wall, a first shoulder wall, a first neck wall, a centered base wall, a second neck wall, a second shoulder wall and a second outer wall wider than the first outer wall by the width of the riser wall, each of said walls being substantially at right angles to the next adjoining walls;

each rail having a bevel cut to form one end face where the cross-sectional orientation is the same as that of the adjoining rail to form a respective bevel joint, the other end face of a first two of said rails being formed by a right angle cut through the entire cross-section of each, and each of the second two of the rails having its other end face formed with a first right angle cut through the rectangular portion of the rail bounded by the base wall, first and second neck walls and the plane of the first and second shoulder walls to form an innermost rectangular cut-back end wall; a second right angle cut through the rectangular portion of the rail bounded by the head wall, second outer wall, plane of the riser wall, and the identical planes of the shoulder walls to form an intermediate cut-back end wall; and a third right angle cut through the rectangular portion of the rail bounded by the step wall, first outer wall, plane of the riser wall, and plane of the shoulder walls to form an outermost end wall; a first longitudinal cut in the plane of the riser wall to connect the outermost end wall and the intermediate end wall; a second longitudinal cut in the plane of the shoulder walls extending from the outermost end wall and intermediate end wall to the innermost end wall; the longitudinal spacing between said outermost end wall and intermediate end wall corresponding to the width of the riser wall of the adjoining rail, and the longitudinal spacing between said intermediate end wall and innermost wall corresponding to the distance between the planes of the step wall and base wall of the adjoining rail; whereby a tongue is formed to cover said other end face of a respective adjoining one of said first two of the rails;

said face sheets engaging said neck walls and being confined at their periphery by said shoulder walls; and means for securing said rails together to form a rigid border frame and for securing said face sheets to said border frame.

3. A building having sides, a roof and floors made from a plurality of modular panels comprising, first floor walls made of a plurality of side-by-side abutting, interlocked, vertical, first totally closed panels, some of which contain window and door components and each having interior and exterior facing sheets and enclosing border frames surrounding all edges of said facing sheets, second floor walls made of a plurality of side-by-side abutting said interlocked vertical first panels separate from said first floor panels, said first panels being primary load-carrying members for carrying the load of the roof, sidewalls and floors, first and second floors made of side-by-side and end-to-end abutting interlocked separate horizontal second panels, a roof made of said interlocked second panels, a plurality of horizontal supports for supporting the floors and roof in spans not directly above an interior supporting wall, and said floor panels lying completely interiorly of the interior facing sheet of said wall first panels and abutting a plane adjacent to and interiorly of the wall panels.

4. The building of claim 3 wherein said horizontal supports are attached to said interior facing sheets of said first panels after the wall panels are erected at the construction site to form vertical load bearing members for providing support for the floor panels at any desired vertical location along the vertical dimension of said first panels, the floor panels of at least one floor being adapted to be located vertically offset from the lower ends of the vertical wall panels for that floor.

5. The building of claim 3, each said horizontal second panels comprising two parallel face sheets;

a rigid rectangular border frame surrounding said sheets and having end rails interconnected by side rails, all of said rails having the same transverse cross-section but with said side rails turned end-for-end relative to one another and with said end rails also turned end-for-end relative to one another so that a first end rail and a first of the side rails have one cross-sectional orientation and the second end rail and the second side rail have the opposite cross-sectional orientation, said cross-sections being so shaped that like border frames juxtaposed side against side will interfit at the sides by sliding engagement along a plane parallel to the longitudinal planes of said face sheets;

each said rail being of generally rectangular transverse cross-section, stepped at a head wall and necked at the opposite base wall to provide, in consecutive adjoining order, a head wall, a center riser wall, a step wall, a first outer wall, a first shoulder wall, a first neck wall, a centered base wall, a second neck wall, a second shoulder wall and a second outer wall wider than the first outer wall by the width of the riser wall, each of said walls being substantially at right angles to the next adjoining walls;

each rail having a bevel cut to form one end face where the cross-sectional orientation is the same as that of the adjoining rail to form a respective bevel joint, the other end face of a first two of said rails being formed by a right angle cut through the entire cross-section of each, and each of the second two of the rails having its other end face formed with a first right angle cut through the rectangular portion of the rail bounded by the base wall, first and second neck walls and the plane of the first and second shoulder walls to form an innermost rectangular cut-back end wall; a second right angle cut through the rectangular portion of the rail bounded by the head wall, second outer wall, plane of the riser wall, and the identical planes of the shoulder walls to form an intermediate cut-back end wall; and a third right angle cut through the rectangular portion of the rail bounded by the step wall, first outer wall, plane of the riser wall, and plane of the shoulder walls to form an outermost end wall; a first longitudinal cut in the plane of the riser wall to connect the outermost end wall and the intermediate end wall; a second longitudinal cut in the plane of the shoulder walls extending from the outermost end wall and intermediate end wall to the innermost end wall; the longitudinal spacing between said outermost end wall and intermediate end wall corresponding to the width of the riser wall of the adjoining rail, and the longitudinal spacing between said intermediate end wall and innermost wall corresponding to the distance between the planes of the step wall and base wall of the adjoining rail; whereby a tongue is formed to cover said other end face of a respective adjoining one of said first two of the rails;

said face sheets engaging said neck walls and being confined at their periphery by said shoulder walls; and means for securing said rails together to form a rigid border frame and for securing said face sheets to said border frame.

6. A building made from a plurality of modular totally enclosed panels comprising, first floor walls made of a plurality of side-by-side abutting interlocked vertical first panels, some of which contain window and door components and each having interior and exterior facing sheets and an enclosing border frame surrounding all edges of said facing sheets with the dimensional size of each panel being measured from the border frame, separate second floor walls made of a plurality of side-by-side abutting said interlocked vertical first panels, said first panels being primary load-carrying members, first and second floors made of side-by-side and end-to-end abutting interlocked horizontal second panels including perimeter panels adjacent said first and second floor walls, each having an upper and lower facing sheet and an enclosing border frame surrounding all edges of said facing sheets with the dimensional size of each panel being measured from the border frame, a second floor of said enclosed second panels having said upper facing sheet being flooring for the second floor and said lower facing sheet being the finished ceiling for the first floor room, a roof made of said interlocked second panels, means for supporting said floor and roof panels from said walls, and said border frames of the perimeter second panels of said first and second floors abutting planes lying interiorly of and adjacent to the interior facing sheets of said first and second floor wall panels.

* * * * *